United States Patent [19]

Morningstar et al.

[11] 4,412,714

[45] Nov. 1, 1983

[54] LATCHING CONNECTOR ASSEMBLY

[76] Inventors: Leroy J. Morningstar, 3 Speyer Rd., Middletown, Pa. 17057; Charles Tighe, Jr., 987 Beech Ave., Hershey, Pa. 17033

[21] Appl. No.: 159,026

[22] Filed: Jun. 13, 1980

[51] Int. Cl.[3] ..... H01R 13/627

[52] U.S. Cl. ..... 339/91 R

[58] Field of Search ..... 339/91 R, 97 P, 103 R, 339/103 M, 125, 120, 210 M, 61 M, 63 M

[56] References Cited

U.S. PATENT DOCUMENTS

| | | | |
|---|---|---|---|
| 4,006,957 | 2/1977 | Narozny | 339/103 M |
| 4,083,615 | 4/1978 | Volinskie | 339/17 F |
| 4,188,083 | 2/1980 | Knowles | 339/99 R |
| 4,211,461 | 7/1980 | Westcott | 339/91 R |

FOREIGN PATENT DOCUMENTS

| | | | |
|---|---|---|---|
| 1500722 | 4/1975 | United Kingdom | 339/91 R |

*Primary Examiner*—Eugene F. Desmond

[57] ABSTRACT

A latching assembly for a multipiece connector is disclosed, comprising a first body side surface recessed between two edge flanges, and retention protuberances projecting outwardly therefrom; a second body side surface from which a medianly slotted tab projects tangentially for latching over one of the connector body protuberances; and a third body side surface from which a T-shaped cantilever spring finger projects tangentially. The spring finger is adapted to include forward flange means for latching over the first and second side surface profiles, and a longitudinal rib protrusion for projecting into the second side surface tab slot for adding increased lateral stability to the overall assembly.

10 Claims, 7 Drawing Figures

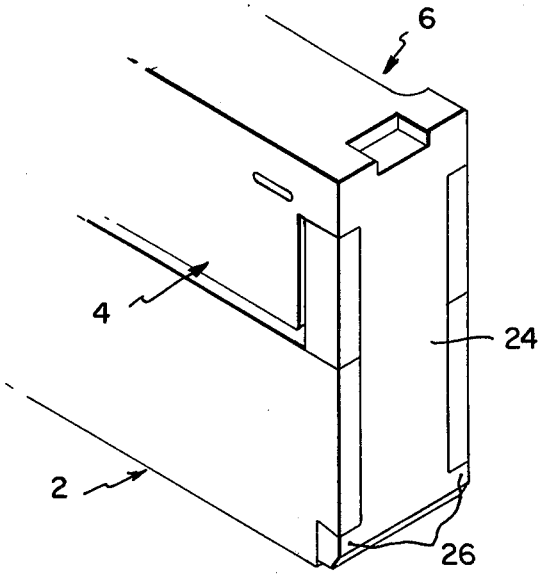
FIG 4
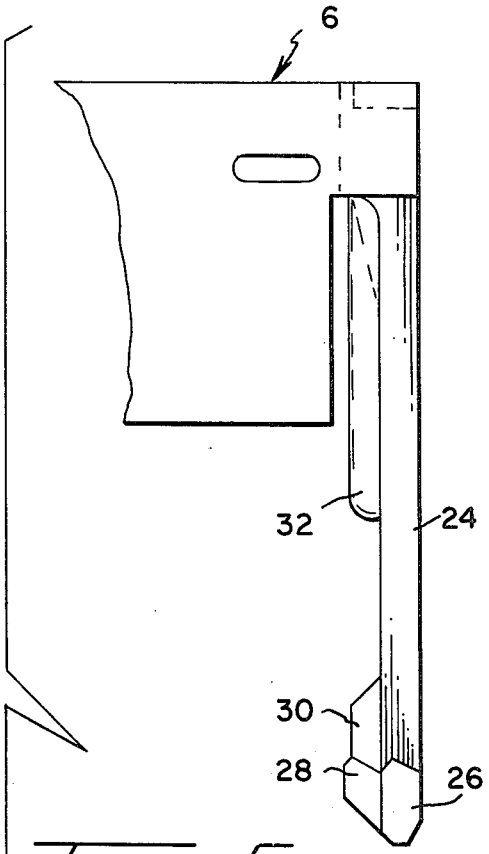
FIG 5
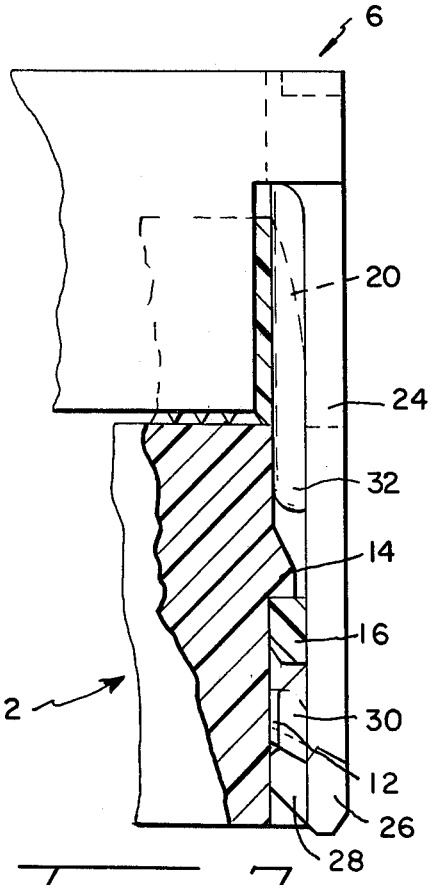
FIG 7
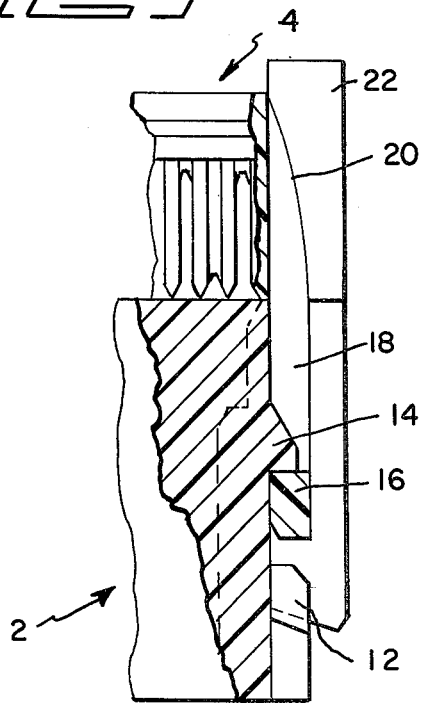

LATCHING CONNECTOR ASSEMBLY

BACKGROUND OF THE INVENTION

1. The Field of the Invention

The present invention relates in general to latching assemblies for multipiece connector components. More specifically, the present invention relates to a three piece connector unit, each piece having a side profile adapted to latch to corresponding profiles of the other two connector components, and to register the parts for assembly.

2. The Prior Art

Many electrical connectors for ribbon cable comprise multiple components. For example, one widely accepted connector for terminating a flat transmission cable comprises three connector components: a connector housing body into which the conductors of the cable are inserted; a connector cover body into which a plurality of contacts are loaded for terminating the cable conductors upon assembly of the cover body to the connector body; and a strain relief body for providing a cable strain relief function upon assembly of the strain relief body to the previously assembled housing and cover bodies. Other connectors, for other applications, common to those skilled in the art, also utilize a three piece configuration and accordingly have need of a convenient and effective latching technique for establishing positive latching between the assembled three component, as well as a need for effectively registering the components during assembly.

Heretofore, a wide variety of profiles have been suggested for establishing latching between three connector components of the type described above. However, no profiled latching technique has been achieved which would provide both adequate latching strength and effective part registration during assembly, in a narrow profile configuration. Moreover, because many of these connectors are intended to be stacked end to end on a pin field or the like, and must therefore be of a miniature scale, it is even more imperative, and difficult, to a achieve a latching scheme for providing the greatest load bearing characteristics, yet in a configuration which achieves same with optimal material utilization due to the overall size restrictions placed upon the connector.

The industry, accordingly, has been in need of a latch profile for multipiece connector assemblies, which would provide a registration function and an adequate resistance to tensile forces introduced into the terminated cable, yet which would be easy to assemble, inexpensive to manufacture, and relatively fail safe. Such a latching structure, preferably would provide redundant retention in order to increase reliability and performance of the latch and minimize the likelihood that ordinary manipulations of the terminated cable would induce failure. Further, the latching features should be aligned in such a manner so that as stresses are applied to the connector assembly and deformation of the connector occurs, the latches tend to latch rather than unlatch. Lastly, the latching structure on the connector bodies should require a minimum utilization of material in keeping with the requirement that the overall size of the connector remain small.

SUMMARY OF THE PRESENT INVENTION

The present invention contemplates a three piece connector assembly, comprising a housing body, a cover body, and a strain relief body, each having an appropriate latching side profile configuration. The housing body includes a side surface recess between two edge flanges and retention protuberances projecting outwardly between the flanges. The cover body is provided with a side surface from which a medianly slotted tab projects tangentially for latching over one of the housing body protuberances, and the strain relief body comprises a side surface from which a T-shaped cantilever spring projects tangentially therefrom to latchingly engage the previously assembled bodies. The spring finger is adapted to include a forward transverse flange for latching over the housing and cover body side profiles, and a longitudinal rib protrusion for projecting into the cover body tab slot for adding increased lateral stability to the resultant assembly. Thus configured, the components of the latch are of a thin profile, yet achieve both latching and registration of the connector parts. Also, stresses applied to the connector assembly or cable terminated thereby will tend to promote integrity of the latching features, rather than unlatching the connector parts.

Accordingly, it is an object of the present invention to provide a profiled latching assembly for joining and registering connector components or the like.

A further object of the present invention is to provide a three piece latching assembly having redundant locking features.

Still further, an object of the present invention is to provide a three piece latching assembly having exceptionally high load bearing capability in the latched condition.

Still further, an object of the present invention is to provide a three piece latching assembly having improved lateral stability in the assembled condition.

Yet a further object of the present invention is to provide a three piece latching assembly featured having means for locking multiple connector components together such that disassembling tensile forces introduced to the assemble components will be distributed along multiple planes of stress and tend to preserve the latches. A further object of the present invention is to provide a latching assembly for joining and registering connector components, which latching assembly requiring minimal material thickness.

Still further, an object of the present invention is to provide a three piece latching assembly which is economically and readily produced.

These and other objects, which will become apparent to one skilled in the art, are achieved by a preferred embodiment which is described in detail below, and which is illustrated in the acompanying drawings.

BRIEF DESCRIPTION OF THE ACCOMPANYING DRAWINGS

FIG. 4 is a perspective view of the connector assembly of FIG. 1 in a fully assembled condition.

FIG. 5 is an exploded partial section view through the connector assembly of FIG. 3.

FIG. 7 is a partial section view through the assembled connector illustrated in FIG. 4.

DETAILED DESCRIPTION OF THE PREFERRED EMBODIMENT

Figure 1:
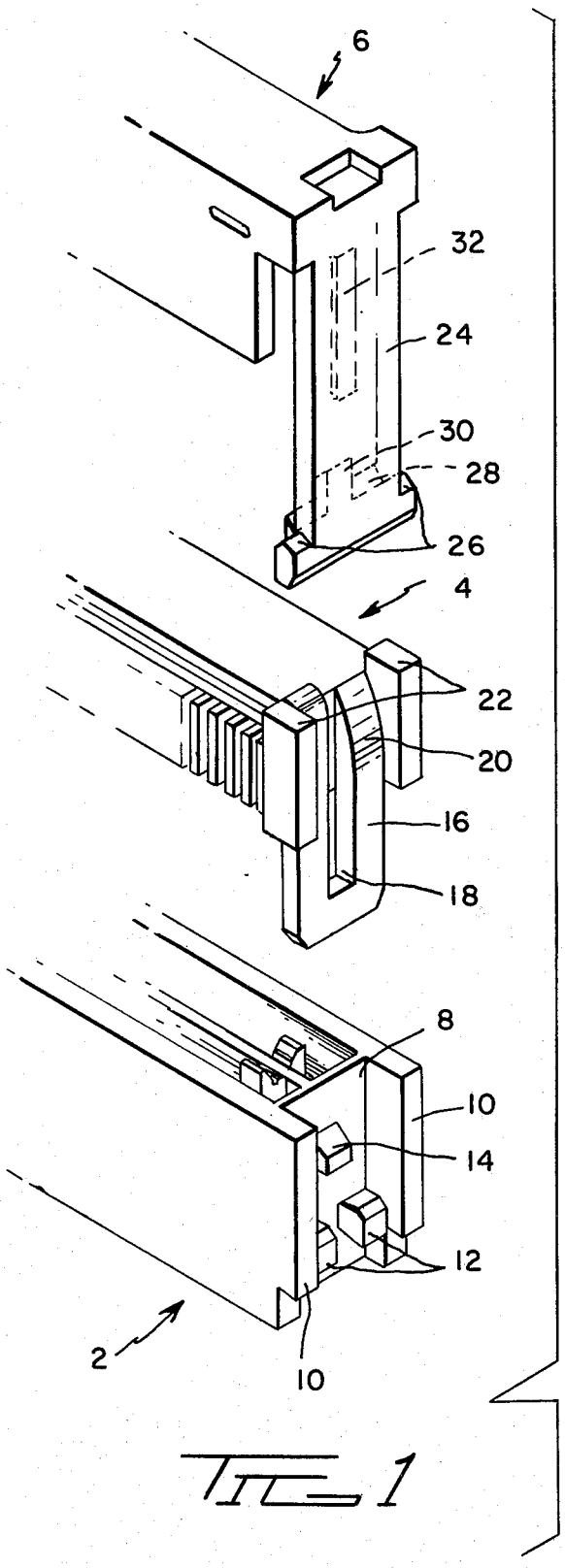
FIG. 1 is an exploded perspective view of the three connector components, each profiled pursuant to the teachings of the present invention.

Referring first to FIG. 1, the subject connector assembly comprises a connector housing 2, a cover component body 4, and a strain relief body 6. The housing body 2 is adapted having a side surface 8 which is recessed below two elongate edge flanges 10. Projecting outwardly from the side surface 8, are a pair of forward retention protuberances 12, and a generally rearward, central retention protuberance 14.

Proceeding to the cover component body 4, a cantilever tab extension 16 is provided to project outward, tangentially from the side of the cover component 4. The cantilever tab 16 is adapted having a medianly located slot 18 therein, which extends from a rearward end of the tab toward a forward end thereof. As shown at numeral 20, the cantilever tab 16 is adapted having a ramped upper surface proximate a rearward end thereof. A pair of cover flanges 22 further comprise the cover body 4, and extend lengthwise along the side edges of the cover body side.

Figure 2:
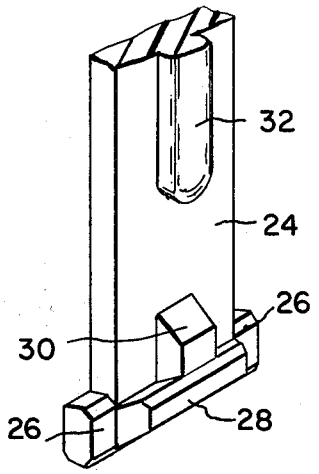
FIG. 2 is a perspective view of the inward side of the T-shaped cantilever spring finger shown in FIG. 1.

Progressing to FIG. 2, viewed in conjunction with FIG. 1, a strain relief cover 6 is configured to provide a T-shaped cantilever spring finger 24 extending tangentially from a side thereof. The cantilever spring finger 24 is adapted having a pair of outwardly directed latching ears 26, a transverse, inwardly directed flange 28, and a central camming protuberance 30 located at a forward end thereof. The central camming protuberance 30 is located centrally of the width of the cantilever spring finger, and is positioned adjacent to the transverse flange 28. Extending longitudinally along an inwardly facing surface of the cantilever spring is an inwardly projecting rib 32.

With initial reference to FIGS. 1 and 3, assembly of the present invention proceeds as follows. The cover component body 4 is registered and connected to the connector housing body 2, as the cantilever tab 16 is projected between the edge flanges 10 of the housing body 2, and thereupon rides over and latches against the central retention protuberance 14 thereof. So located, the upper surface of the cantilever tab 16 is generally the same height as the top surfaces of the forward retention protuberances 12. The cover component 4 is thereby registered and latchingly retained against the connector housing body 2 as shown by FIG. 3.

Figure 3:
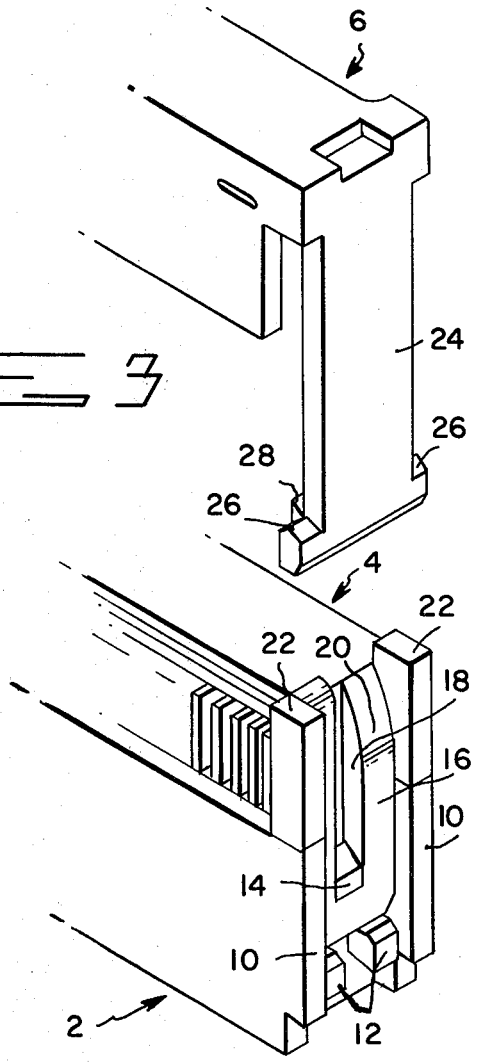
FIG. 3 is an exploded perspective view of the connector assembly of FIG. 1, with two of the connector components assembled to one another.
Figure 6:
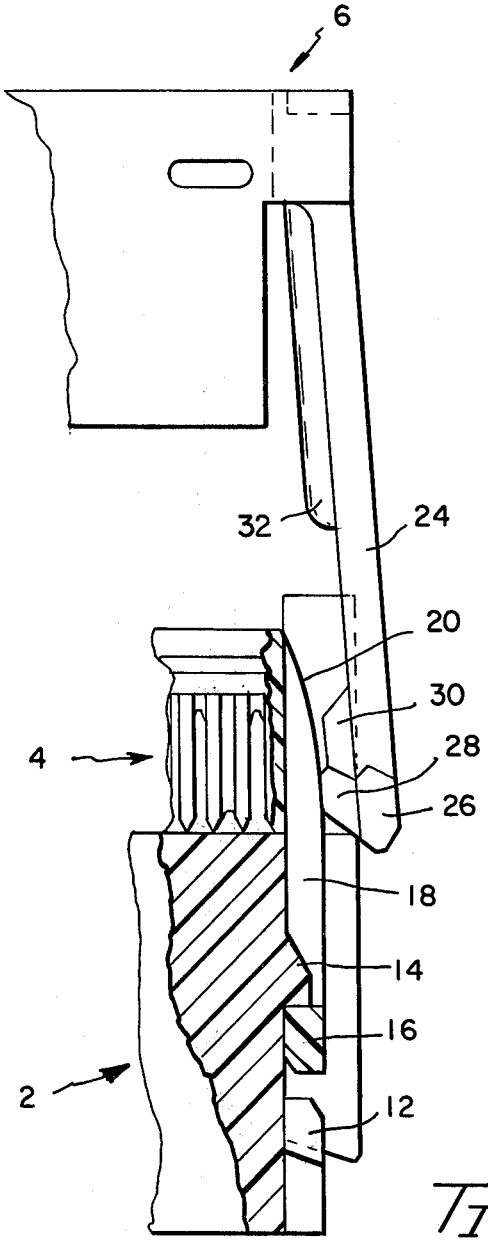
FIG. 6 is a partial section view of the connector assembly of FIG. 3, with the third connector component in the process of assembly to the first two assembled components.

With continued reference to FIG. 3, and additional reference to FIG. 6, the strain relief cover body 6 is brought against the cover component body 4, which has been preassembled to the connector housing body 2 as described above. The cantilever spring finger 24 of the strain relief cover body 6, registers the body 6 to the other bodies 2, 4, and is aligned between the edge flanges 10 of the connector housing body 2, with the transverse flange 28 of the cantilever spring riding against the upper surface 20 of the cantilever tab 16, and the central camming protuberance 30 of the cantilever spring finger 24 projecting into the median slot 18 of the cantilever tab 16. The cantilever spring finger 24 is resiliently deflected outwardly in riding against the ramped upper surface 20 of the cantilever tab 16, and exerts a resilient inward spring force which tends to maintain the cantilever spring finger in appropriate registration between the edge flanges 10. At this point in the assembly procedure, the side ears 26 of the cantilever spring finger proceed against the outward surfaces of the edge flanges 10, and upon final assembly of the strain relief cover 6 to the cover component body 4, the latching ears 26 latch over forward ends of the edge flanges 10 as shown by FIGS. 4 and 7.

Continuing, with reference to FIGS. 4, 6 and 7, as the cantilever spring finger 24 slides further between the edge flanges 10, the longitudinal rib 32 thereof enters the median slot 18 of the cantilever tab 16. The presence of the longitudinal rib 23 therein, contributes considerably to the lateral stability of the assembled components, as well as contributing towards the appropriate alignment of the cantilever spring finger. Upon completing the assembly of the strain relief cover 6 to the cover component body 4 as illustrated in FIG. 7, the transverse flange 28 of the cantilever spring finger 24 passes over and latches against the forward retention protuberances 12 of the connector housing body 2. Simultaneously, the central camming protuberance 30 cams over the forward end of the cantilever tab 16, thereby departing from the median slot 18 to latch over the forward end of the cantilever tab.

Thus, in the fully assembled condition illustrated by FIGS. 7 and 4, the three connector components 2, 4, and 6, are held in a secure latching arrangement with the cantilever tab 16 latching over the central protuberance 14, the transverse flange 28 of the cantilever spring finger 24 latching against the forward retention protuberances 12, the central camming protuberance 30 of the cantilever spring finger latching over and against the forward end of the cantilever tab 16, and the two outwardly directed latching ears 26 of the cantilever spring finger latching over and against forward ends of the edge flanges 10. It will be appreciated that this redundancy of latching features achieves a more secure and positive latching than could be accomplished otherwise. Moreover, upon a close examination of the forward end of the cantilever spring finger 24, it will be appreciated that the latching occurs along multiple planes. In other words, the latching ears 26 engage against the forward ends of the edge flanges 10 in one tangential plane, and the transverse flange 28 and camming protuberance 30 latch in a second tangential plane. Such a configuration serves to distribute forces which would tend to disassemble the connector; thereby resulting in a much stronger latch.

Further, the components of the latch described above, achieve both a latching and a registration function, and generally are of a narrow material thickness. This optimal use of material tends to make the side profile of the connector as compact as possible for stacking applications, while still achieving substantial load bearing characteristics. Furthermore, the latching features of the present invention, aligned in the manner set forth above, tend to latch rather than unlatch as stresses are applied to bodies 2, 4, and 6. That is, the interlocking cooperation of latching features of the present invention is promoted, rather than defeated, by the stressful manipulation of connector parts, and the latch remains intact.

It will be appreciated that while the latching features constituting the preferred embodiment of the present invention are represented as component profiled sides of three connector parts, three components need not generally be used. For example, a two component connector may utilize the present latching scheme by eliminating the profile of body 4, or by incorporating side profiles of bodies 2 and 4 into one element. Other variations on the above teachings, which will be apparent to those skilled in the art, are intended to be covered hereby.

While the above describes a preferred embodiment of the present invention, other embodiments, which will become apparent to one skilled in the art, and which utilize the teachings herein set forth, are intended to be within the scope and spirit of the present invention.

What is claimed is:

1. A latching assembly for a multipiece connector comprising:

first elongate side surface means recessed between two longitudinal, outwardly directed edge flanges, said first side surface means having profiled retention protuberance means projecting outwardly between said edge flanges:

second elongate side surface means having a T-shaped cantilever spring finger projecting outward, tangentially therefrom, said spring finger having an inwardly directed transverse flange at a forward end, and an inwardly directed camming protuberance located rearward and adjacent said flange, said flange latchingly engaging over said retention protuberance means and said camming protuberance disposed between said retention protuberance means as said spring finger is inserted between said edge flanges, and said spring finger having outwardly directed ear portions at a forward end for latchingly engaging over forward ends of said edge flanges.

2. A latching assembly for a multipiece connector comprising:

first elongate side surface means recessed between two longitudinal, outwardly directed, edge flanges, said side surface means having profiled retention protuberance means projecting outwardly between said edge flanges;

second elongate side surface means having cantilever extension means projecting outward, tangentially therefrom, said extension means projecting between said edge flanges and having longitudinal slot means extending medianly therein for latchingly engaging over said retention protuberance means;

third elongate side surface means having cantilever spring finger means projecting outward, tangentially therefrom, said cantilever spring finger means comprising inwardly directed transverse flange means for latchingly engaging over said retention protuberance means, and camming protuberance means for riding within said longitudinal slot means and latchingly engaging over a forward end of said cantilever extension means.

3. A latching assembly as set forth in claim 2, said cantilever spring finger means further comprising inwardly directed longitudinal rib means for positionment within said longitudinal slot means.

4. A latching assembly as set forth in claim 2, said cantilever spring finger means comprising side projection means at a forward end for engaging over a forward end of said longitudinal edge flanges.

5. A latching assembly as set forth in claim 2, wherein said retention protuberance means comprises three profiled retention protuberances, two of said protuberances being spaced apart and parallel and located adjacent one forward end of said first side surface means, and the other third of said protuberances located intermediate of and adjacent an opposite end of said first side surface means.

6. A latching assembly as set forth in claim 5, said transverse flange means latching over said two parallel protuberances, and said slot means of said cantilever extension means latching over said third protuberance.

7. A latching assembly for a multipiece connector comprising:

a first connector body having an elongate side surface recessed between two longitudinal outwardly directed, edge flanges, three profiled retention protuberances projecting outwardly from said side surface between said flanges, two of said protuberances being spaced apart and parallel and located adjacent one forward end of said side surface, and the other third of said protuberances located intermediate of and adjacent an opposite end of said side surface;

a second connector body having an elongate generally planar cantilever beam extension projecting tangentially outward from a side surface of said second body, said beam extension having a median longitudinal slot extending therein from a rearward one end, and an opposite forward end of said beam extension projecting between said two first body flanges with said slot latching over said third protuberance thereof, to hold said first and second bodies in abutment;

a third connector body having an elongate, T-shaped cantilever spring finger projecting outward and tangential from a side of said third body, said cantilever finger comprising a central lengthwise portion, an inwardly directed transverse flange spanning the width of said finger at a forward end, and an inwardly directed camming protuberance positioned adjacent said transverse flange at said forward end generally central of said finger width, said camming protuberance riding within said longitudinal slot of said beam extension as said third body is brought into abutment against said second body, and camming over and into abutment against said forward end of said second body beam extension whereupon, said transverse flange latches over and into abutment against said two parallel first body protuberances to latch said third body to said assembled first and second bodies.

8. A latching assembly as set forth in claim 7, said T-shaped cantilever spring finger of said third connector body further comprising opposite latching ears projecting outwardly at a forward end from respective sides of said central finger portion to latch over and into abutting engagement against forward ends of said longitudinal side flanges of said first connector body.

9. A latching assembly as set forth in claim 7, said T-shaped cantilever spring finger of said third connector body further comprising an inwardly protruding longitudinal rib extending lengthwise from a rearward base end of said finger for projecting into said longitudinal slot of said second body beam extension as said third body is brought against said assembled first and second bodies.

10. A latching assembly for a multipiece connector comprising:

a first connector body having an elongate side surface recessed between two longitudinal, outwardly directed, edge flanges, three profiled retention protuberances projecting outwardly from said side surface between said flanges, two of said protuberances being spaced apart and parallel and located adjacent one forward end of said side surface, and the other third of said protuberances located intermediate of and toward an opposite end of said side surface;

a second connector body having an elongate generally planar cantilever beam extension projecting tangentially outward from a side surface of said second body, and beam extension having a median longitudinal slot extending therein from a rearward one end, and an opposite forward end of said beam extension projecting between said two first body flanges with said slot latching over said third protuberance thereof, to hold said first and second bodies in abutment;

a third connector body having an elongate T-shaped cantilever spring finger projecting and tangential from a side of said third body; said cantilever finger comprising a central lengthwise portion having an inwardly protruding longitudinal rib extending lengthwise therealong from a rearward base end, opposite latching ears projecting outwardly at a forward end from respective sides of said central lengthwise portion, an inwardly directed transverse flange spanning the width of said finger at said forward end, and an inwardly directed camming protuberance located adjacent said transverse flange generally central of said finger width, said camming protuberance and said rib riding within said longitudinal slot of said beam extension as said third body is brought into abutment against said second body, said camming protuberance camming over and into abutment against said forward end of said second body beam extension, whereupon said transverse flange latches over and into abutment against said two parallel first body protuberances, and said latching ears latch over into abutting engagement against forward ends of said longitudinal side flanges of said first body to latch said third body to said assembled first and second bodies.

* * * * *